United States Patent [19]

Padovan

[11] Patent Number: 4,480,344

[45] Date of Patent: Nov. 6, 1984

[54] DIVAN-BED

[76] Inventor: Alfio Padovan, Via Nuove Fratte, 61, 33082 Azzano Decimo (PN), Italy

[21] Appl. No.: 478,028

[22] Filed: Mar. 23, 1983

[30] Foreign Application Priority Data

Apr. 9, 1982 [IT] Italy ..... 60365/82[U]

[51] Int. Cl.[3] ..... A47C 17/04

[52] U.S. Cl. ..... 5/48; 5/12 R; 5/17; 5/41; 297/111

[58] Field of Search ..... 5/12 R, 13, 17, 23, 5/41, 44 R, 44 B, 46 R, 46 B, 47, 48; 297/111, 105

[56] References Cited

U.S. PATENT DOCUMENTS

| | | | |
|---|---|---|---|
| 1,061,986 | 5/1913 | Coopersmith | 5/23 |
| 1,527,416 | 2/1925 | Konrad | 5/13 |
| 2,988,757 | 6/1971 | Hubbell | 297/105 |
| 3,432,203 | 3/1969 | Cavalli | 5/13 |
| 3,747,135 | 7/1973 | Barabas | 5/13 |

FOREIGN PATENT DOCUMENTS

| | | | |
|---|---|---|---|
| 1057546 | 10/1953 | France | 5/12 |
| 1322818 | 2/1963 | France | 5/12 |

*Primary Examiner*—Alexander Grosz
*Assistant Examiner*—Michael F. Trettel
*Attorney, Agent, or Firm*—Fitzpatrick, Cella, Harper & Scinto

[57] ABSTRACT

A divan-bed (10) has a frame (11) cooperating with side walls (14) and with a crosswise element (15) that connects said side walls, whereby the frame (11) consists of five consecutive, articulated leaves (12) covered with a one-piece mattress (13) and the two end leaves (12) are placed next to each other to form, in the divan position, the seat (20) and seat back (21) respectively of the divan. The intermediate leaves (12) with their relative portions of mattress (13) are folded and stored in crooked succession within a hidden zone in the base of the divan underneath the zone wherein said end leaves (12) are placed next to each other, all leaves and the mattress being extendable to form the bed.

8 Claims, 5 Drawing Figures

Figure 2:
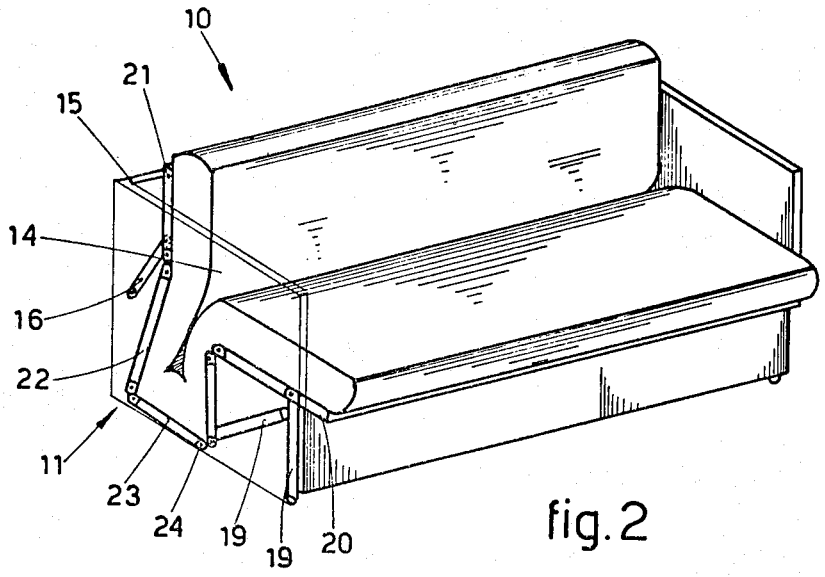

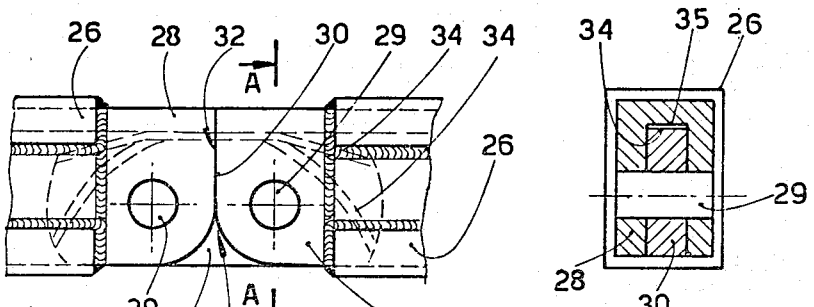
fig. 5
fig. 4
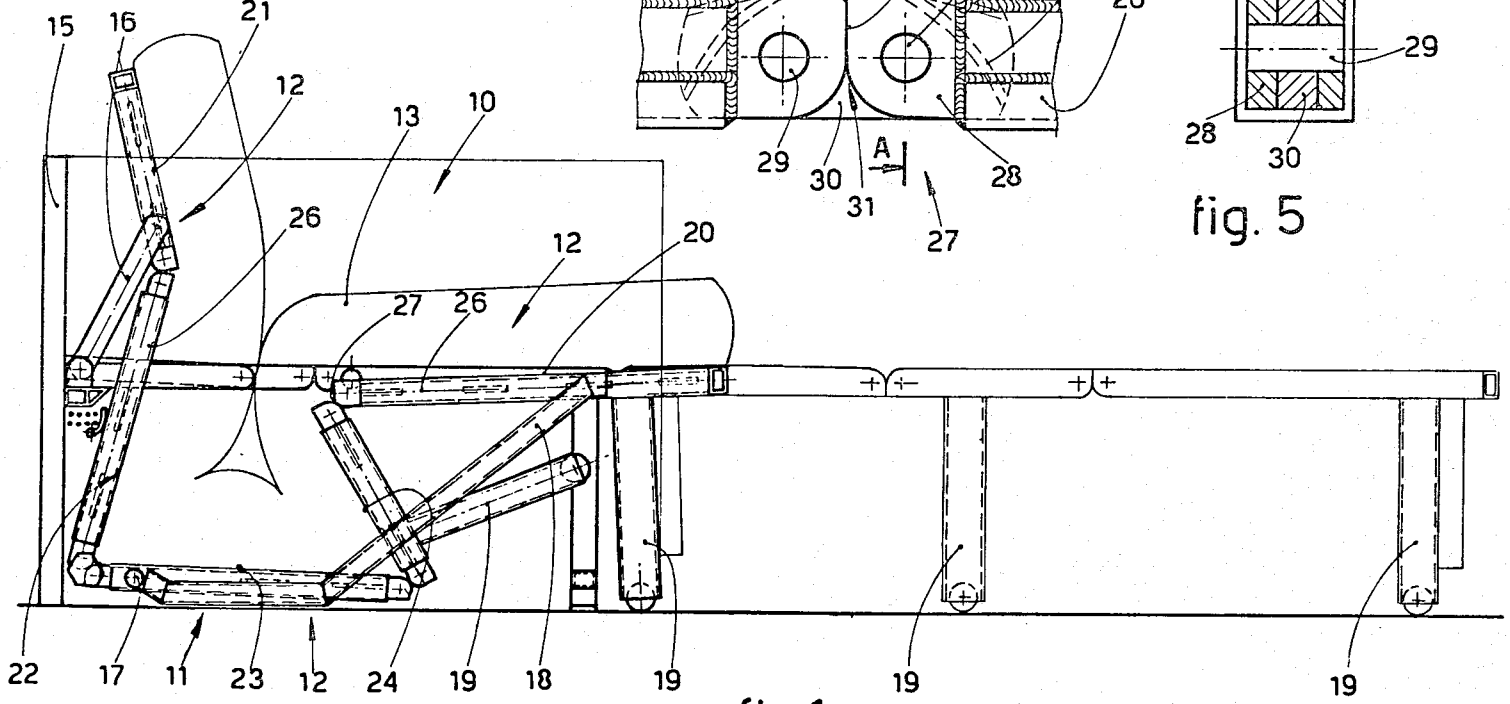
fig. 1

DIVAN-BED

This invention concerns a divan-bed. To be more exact, the invention concerns a very compact divan upholstered with one single mattress element adhering to a frame consisting of a plurality of articulated elements, whereby said divan can be speedily and readily converted into a single or double bed by extending said articulated elements.

Solutions for a single or double divan-bed are already known. Many of said solutions envisage a telescopic frame on which the cushions forming the night-time bedding are laid after the frame has been extended. A telescopic frame entails complexity owing to the need to level the various telescopic elements, and there is the further drawback that the mattress consists of various cushions and therefore has not the most suitable characteristics for repose at night.

A system for levelling the telescopic elements automatically is known. This system enables the surface of the bed to be levelled without having to use cushions having a differentiated thickness but does not lessen the complications involved in the divan-bed/divan conversion owing to the need to move and recompose the cushions forming the upholstery of the divan-bed in a pre-set order.

A solution to overcome this latter problem has already been proposed which envisages a frame consisting of three consecutive flat leaves to which a mattress made in one piece is secured; said leaves form the horizontal seat, seat back and rear portion of the divan respectively, said surfaces being extended on the same plane to constitute the bed.

However, this solution bends the mattress considerably between the seat back and the rear portion and, above all, entails a great depth of the divan itself, which has a configuration with an unattractive, appearance and a big overall size.

The technical problem tackled by our invention, therefore, is to provide a divan-bed which can be speedily and readily converted and which comprises advantageously a mattress made of only one piece, whereby said divan-bed has a modest depth and a satisfactory appearance.

The divan-bed of the invention has its mattress adhering to the frame and envisages advantageously reduced folds of the mattress and a simple, economical frame.

Moreover, the divan-bed of the invention offers considerable aesthetic and functional advantages, since the portion of the mattress which is surplus in the divan position is folded and stored in a hidden part forming the base of the divan.

Besides, the divan-bed of the invention can have the seat surface horizontal or sloped in the divan position and thereby offers a possibility of choices to suit specific requirements during design work.

The invention is therefore embodied with a divan-bed characterized by comprising a frame consisting of five consecutive articulated leaves covered with a mattress, whereby the two end leaves are placed next to each other in the divan position so as to form the seat and seat back respectively of the divan, whereas the intermediate leaves with their relative portions of mattress are folded and stored in crooked succession within a hidden zone in the base of the divan below the zone of union of said end leaves, all leaves and the mattress being extendable to form the bed.

According to the invention the seat leaf and its neighbouring leaf comprise fixed supports, whereas the other leaves cooperate with supporting and guiding means.

Figure 3:
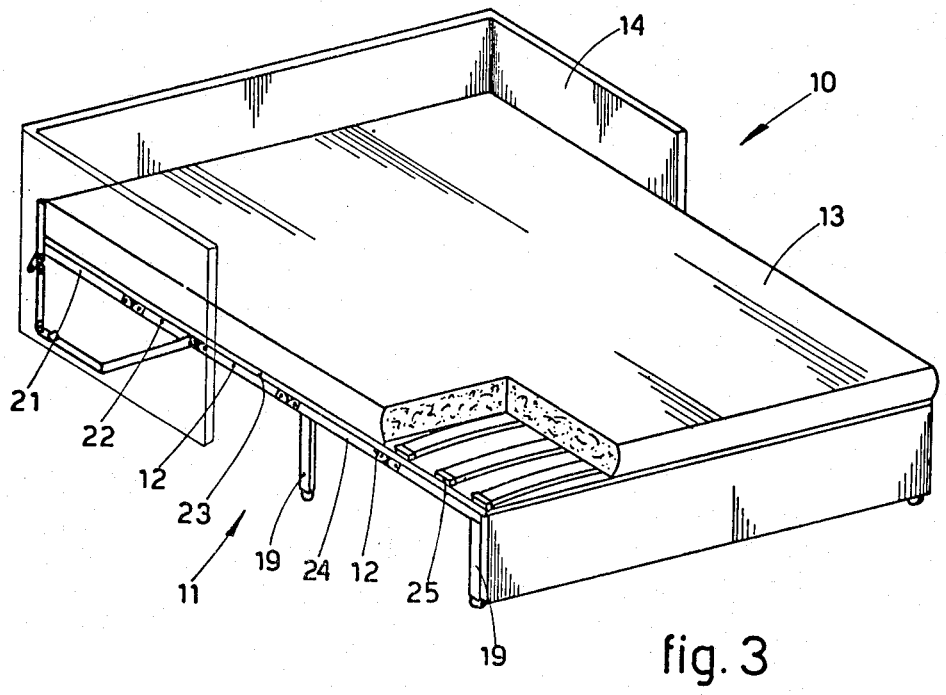

We shall give hereinafter a description of one example of the embodiment of the divan-bed of the invention together with the tables, wherein:

FIG. 1 gives a side view of the divan-bed wherein the frame of the same is shown in its folded position and extended position;

FIG. 2 gives a diagrammatic three-dimensional view of the divan-bed in its divan position;

FIG. 3 gives a diagammatic three-dimensional view of the divan-bed in its bed position;

FIG. 4 gives a side view of the means connecting two tubular segments;

FIG. 5 shows a section of said connecting means.

With reference to the figures the divan-bed 10 of the invention comprises a frame 11 consisting of five articulated leaves 12 to which a one-piece mattress 13 is secured, and also of two side walls 14 and a crosswise element 15 connecting the two side walls 14 in the rear zone forming the seat back of the divan-bed 10.

Said frame 11 is folded in the divan position and the two end leaves 12 are next to each other and form the seat surface 20 and seat back surface 21 respectively of the divan, whereas the three intermediate leaves 12 are folded into the underlying hidden zone that forms the base of the divan.

The seat back leaf 21 is linked to said crosswise element 15 by two connecting rods 16 hinged on said crosswise element 15 and on said leaf 21.

The middle intermediate leaf 23 next to the leaf articulated with the intermediate leaf 22 neighbouring the seat back leaf 21 has at its side a small roller 17 engaged in supporting and guiding means 18 located in each side wall 14, whereby said means 18 consist of a groove which makes said small roller 17 follow a pre-set path during the opening and folding of said frame 11.

The intermediate leaf 24 next to the seat leaf 20 comprises legs 19, as also does the seat leaf 20, for support on the floor.

Each leaf 12 is formed with a springy surface 25 which consists of laminated wooden strips adequately supported and which is provided at each of its two side edges with a tubular segment 26 that bears said surface 25.

Said leaves 12 are reciprocally articulated with joints 27 linking the respective segments 26.

With reference to FIGS. 4 and 5 the joints 27 consist of two fork-wise elements 28, of which each is solidly fixed to one end of said tubular segment 26 and comprises a hole for the insertion of a through crosswise pin 29.

Said pin 29 also cooperates with a connecting plate 30 located between the two fork-wise elements 28.

Said fork-wise elements 28 are in mutual contact through the end surface 31 of the fork-wise elements 28. Said end surface 31 comprises a flat area 32 which prevents the two segments 26 from forming an angle in one direction, and also comprises a curved portion 33 concentric with said pin 29, whereby said curved portion 33 enables the two segments 26 to form an angle in the other direction.

The angle formed between the two segments 26 is restricted by the constrast surfaces 34, which are shaped to suit the angular displacement required and are comprised on said plate 30 and which cooperate with the inner surfaces 35 of the tubular segments 26.

For conversion to a divan-bed, it is enough to pull out the front part of the seat leaf 20 and the successive leaves 12 will automatically be extended in a level manner.

Instead, conversion into a divan takes place by partially lifting said front part and thrusting it towards the rear part of the divan-bed 10.

According to the invention suitable spring means may be envisaged which cooperate with the joints in assisting the divan-bed/divan conversion, which becomes even faster and easier.

As can be seen clearly in the attached drawings, the divan-bed 10 of the invention is very compact and simple and also makes it possible to adopt restricted folding of the joints 27 and therefore of the mattress 13.

It is possible within the scope of the invention to apply variants to the joints and to the structural elements and accessories of the frame to suit the specific requirements involved.

INDEX

10—Divan-bed
11—Frame of divan-bed
12—Articulated leaves
13—Mattress
14—Side walls
15—Seat back element
16—Rods connecting seat back element to seat back leaf
17—Small roller
18—Means supporting and guiding the small roller
19—Supporting legs
20—Seat leaf
21—Seat back leaf
22—Intermediate leaf neighbouring seat back leaf
23—Middle intermediate leaf
24—Intermediate leaf next to seat leaf
25—Springy surface
26—Tubular segments
27—Articulated joints
28—Fork-wise elements
29—Through pin
30—Connecting plate
31—End surface of fork-wise element
32—Flat portion
33—Curved portion
34—Contrast surface
35—Inner surface of tubular segments.

I claim:

1. A divan-bed comprising a frame cooperating with side walls and with a crosswise element which connects said side walls, said frame including five consecutive, articulated leaves covered with a one-piece mattress, the two end leaves being placed next to each other to form, in the divan position, the seat and seat back of the divan, the intermediate leaves together with the related portions of the mattress being folded and stored in crooked succession within a hidden zone in the base of the divan underneath the zone where said end leaves are placed next to each other, all of said leaves and related portions of the mattress being extendable to form the bed.

2. A divan-bed as in claim 1, wherein said frame is guided during the divan-bed/divan conversion by two connecting rods hinged on said crosswise element and on said seat back leaf and also by two small rollers secured to the middle intermediate leaf , and wherein each of said small rollers is engaged in guide means comprising a groove formed on the inner side of each side wall.

3. A divan-bed as in claim 2, wherein each leaf comprises a springy surface which is equipped at each of its two side edges with a tubular segment supporting said surface.

4. A divan-bed as in claim 1 wherein each leaf comprises a springy surface which is equipped at each of its two side edges with a tubular segment supporting said surface.

5. A divan-bed as in claim 4, wherein the leaves are reciprocally articulated with joints located between the respective segments.

6. A divan-bed as in claim 5, wherein each joint comprises two fork-wise elements, each of which is solidly fixed to the end of the tubular segment and includes a hole for the insertion of a crosswise through pin, which also cooperates with a connecting plate located between the two fork-wise elements.

7. A divan-bed as in claim 6, wherein said fork-wise elements are in contact with each other through an end surface of each, which comprises a flat portion able to prevent the two segments from forming an angle between themselves in one direction and also comprises a curved portion concentric with said pin and able to permit the two segments to form an angle between themselves in the other direction.

8. A divan-bed as in claim 7, wherein the angle formed by the two segments is restricted by contrast surfaces shaped to suit the pre-set angular displacement, whereby said contrast surfaces cooperate with the inner surfaces of the ends of the tubular segments.

* * * * *